United States Patent [19]

Dunn et al.

[11] Patent Number: 4,682,834

[45] Date of Patent: Jul. 28, 1987

[54] MULTIPLE CONTACT ZERO INSERTION FORCE CONNECTOR

[75] Inventors: Robert B. Dunn, Gloucester; Bruce Wiltshire, Kanata, both of Canada

[73] Assignee: Northern Telecom Limited, Montreal, Canada

[21] Appl. No.: 699,424

[22] Filed: Feb. 7, 1985

[51] Int. Cl.[4] ..... H01R 13/62

[52] U.S. Cl. ..... 439/267; 439/260; 439/630

[58] Field of Search ..... 339/74 R, 75 MP, 176 MP

[56] References Cited

U.S. PATENT DOCUMENTS

| | | | |
|---|---|---|---|
| 3,963,317 | 6/1976 | Eigenbrode et al. | 339/74 R |
| 3,982,807 | 9/1976 | Anhalt et al. | 339/75 MP |
| 4,159,154 | 6/1979 | Arnold | 339/75 MP |
| 4,179,177 | 12/1979 | Lapraik | 334/74 R |
| 4,274,694 | 6/1981 | Leather | 339/74 R |
| 4,392,705 | 7/1983 | Andrews, Jr. et al. | 339/75 MP |
| 4,487,468 | 12/1984 | Fedder et al. | 339/75 MP |

*Primary Examiner*—John McQuade

*Attorney, Agent, or Firm*—Sidney T. Jelly

[57] ABSTRACT

A multiple contact connector has an elongate actuating member which is reciprocally mounted in a housing holding the contacts, the contacts in one or more linear arrays. On longitudinal reciprocation of the actuating membert it is also caused to reciprocate up and down in a direction normal to the longitudinal direction. In so doing it pushes on the contacts, deflecting them sideways. The connector is then assembled or inserted, after which the actuating member is moved to release the contacts. A substantially zero insertion force is obtained.

16 Claims, 9 Drawing Figures

MULTIPLE CONTACT ZERO INSERTION FORCE CONNECTOR

This invention relates to multiple contact connectors in which one member carrying a plurality of contacts is inserted into another member also carrying a multiplicity of contacts, with electrical contact occurring between the two sets of contacts. In particular the invention relates to multiple contact connectors as are used for connecting circuit boards to back planes and similar parts of communications equipment. By zero insertion force is meant that substantially no force is required to overcome frictional and displacement loads as the two sets of contacts are moved into position.

In operation, it is a general requirement that a minimal contact force should exist between contacts. This contact force is usually obtained by at least one of the contact members of a pair being spring biased toward the other contact. Before insertion, the spring biased contact takes up a free position from which it must be displaced, or deflected, as the other terminal is inserted or positioned. With a large number of contacts the force required to displace or deflect the spring biased contacts becomes quite substantial. Added to this is the frictional forces between contacts.

It has been proposed to mount connector parts on the back plane which have provision for moving the contacts out of position during insertion of the mating connector part, the contact being released when the two connector parts are fully assembled. It is necessary to provide the contact withdrawal facility at every possible mounting position at the time of assembly of the enclosure structure embodying the back plane as it is at least extremely difficult, if not impossible, to add this facility at a later date. Such facility is quite expensive and requires a high initial capital outlay, with every board position having the contact withdrawal facility.

However, in the majority of situations, all board mounting positions are not used at initial installation of the enclosure structure. It is a feature of the present invention that substantially normal contact carrying connector parts are mounted on the back plane and the contact withdrawal facility is provided on the circuit boards. By this means the cost of the contact withdrawal mechanism only occurs at the time a circuit board is connected in to the back plane. Thus the capital outlay is spread over a period of time, from initial installation until the time the final circuit board is added.

The present invention provides a multiple contact connector part, for attachment to an edge of a circuit board, the part comprising an elongate housing, a plurality of cantilever spring contacts mounted in the housing, in one or more linear arrays, an elongate actuating member mounted for reciprocal longitudinal movement in the housing and interengaging formations on the housing and the elongate actuating member which on reciprocal movement of the elongate member, move it reciprocally in a direction normal to the longitudinal movement to move the contacts out of a contact position and return the contacts to a contact position.

The contacts can be in a single linear array or in, for example, two parallel linear arrays with the elongate member acting on both arrays.

The invention also provides a circuit board with a first elongate housing, cantilever spring contacts and elongate member on one edge or on opposite edges of the board. The invention further provides a multiple contact connector comprising two connector parts, a first connector part comprising an elongate housing, cantilever spring contacts and elongate actuating member, and a second connector part comprising a second elongate housing having contacts for engagement with the cantilever spring contacts in the first elongate housing.

The invention will be readily understood by the following description of certain embodiments, by way of example, in conjunction with the accompanying drawings, in which.

Figure 6:
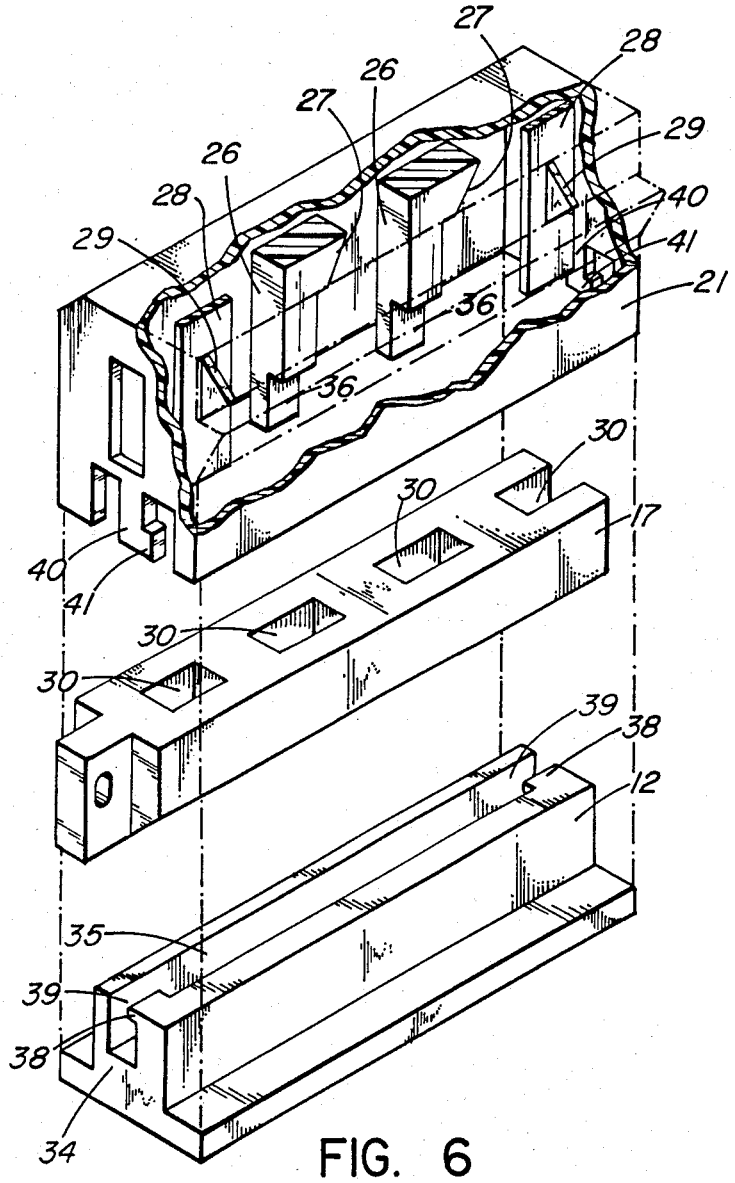
Figure 7:
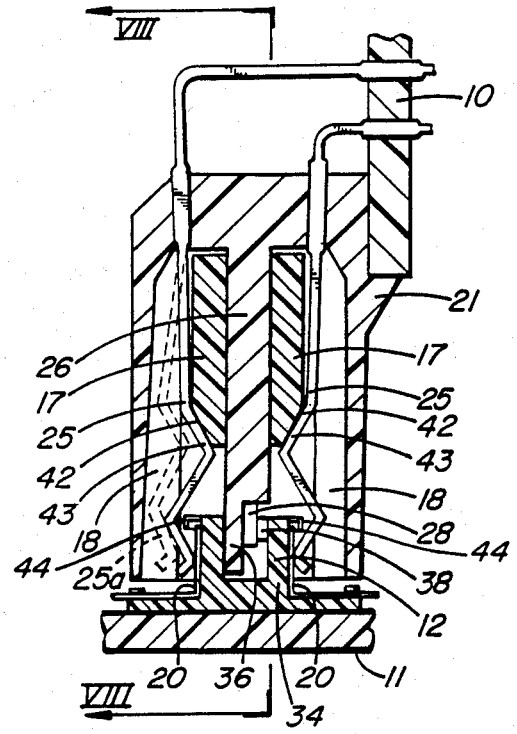
Figure 8:
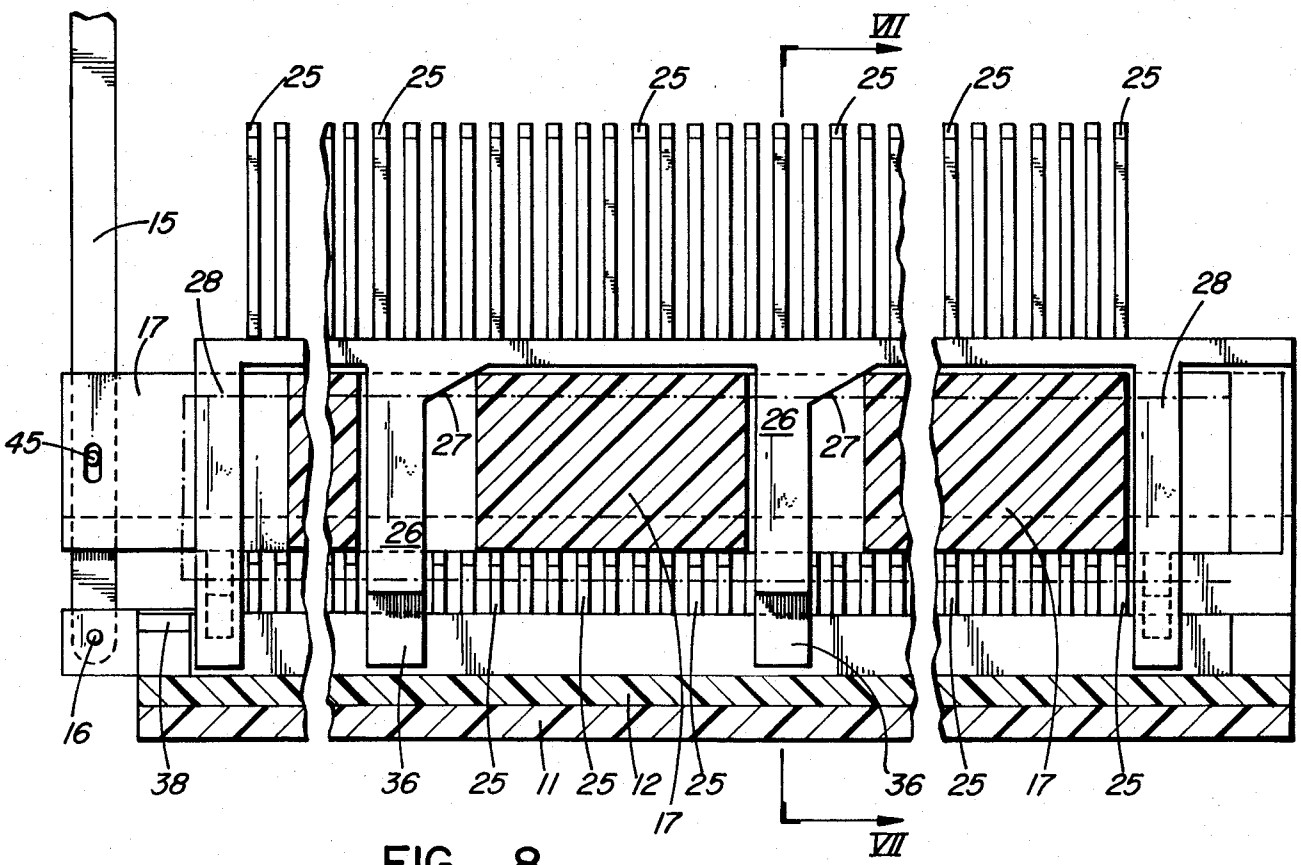

FIG. 6 1s a phantom illustration of various items of a connector;

FIG. 7 is a transverse cross-section through a connector, on the line VII—VII of FIG. 8;

FIG. *7a* is a partial cross-section, similar to FIG. 7, illustrating the deflected position of contact members; and FIG. 8 is a longitudinal cross-section on the line VIII—VIII of FIG. 7.

Figure 1:
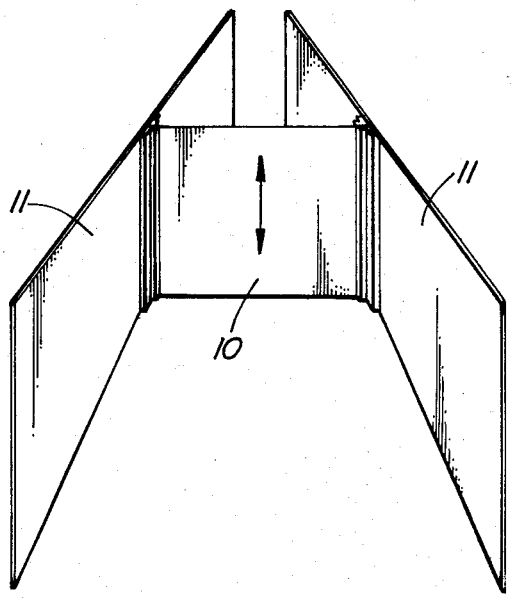
FIG. 1 is a perspective view illustrating a "side entry" form of connection, the circuit board having connector parts on opposite edges.
Figure 2:
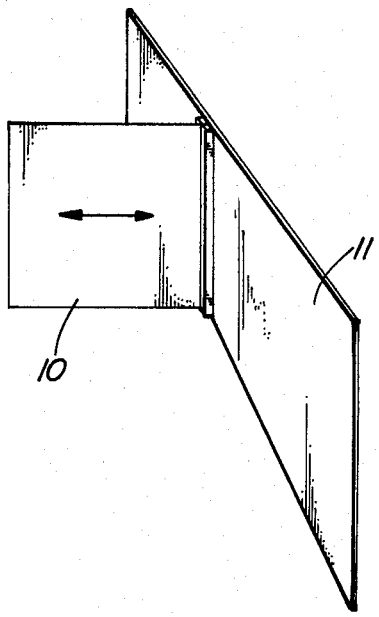
FIG. 2 is a perspective view of a more conventional front entry form of connection.

FIGS. 1 and 2 illustrate two ways circuit boards may be inserted. FIG. 1 illustrates a "side entry" insertion, the circuit board 10 inserted, and removed, by being moved sideways, a connector part on opposite edges mating with another connector part on a support structure or housing, indicated at 11. In FIG. 2 is illustrated the more conventional front entry where a connector part on the edge of a circuit board is pushed straight in to another connector part, with no relative lateral movement.

In FIG. 2, as the board is pushed in, with a conventional connector, the contacts on one of the boards must be displaced or deflected sideways, simultaneously. This can result in high forces to insert the board. In FIG. 1, the contacts are deflected one by one and so the insertion force builds up continuously. However, a far bigger problem in this form of insertion is the prevention of damage to contacts by the lateral movement of one set of contacts relative to the other set. In fact, the contacts will be bent and damaged if a circuit board was inserted in this manner, unless some special provisions are made to prevent contact between the separate sets of contacts before the circuit board is completely inserted.

Figure 3:
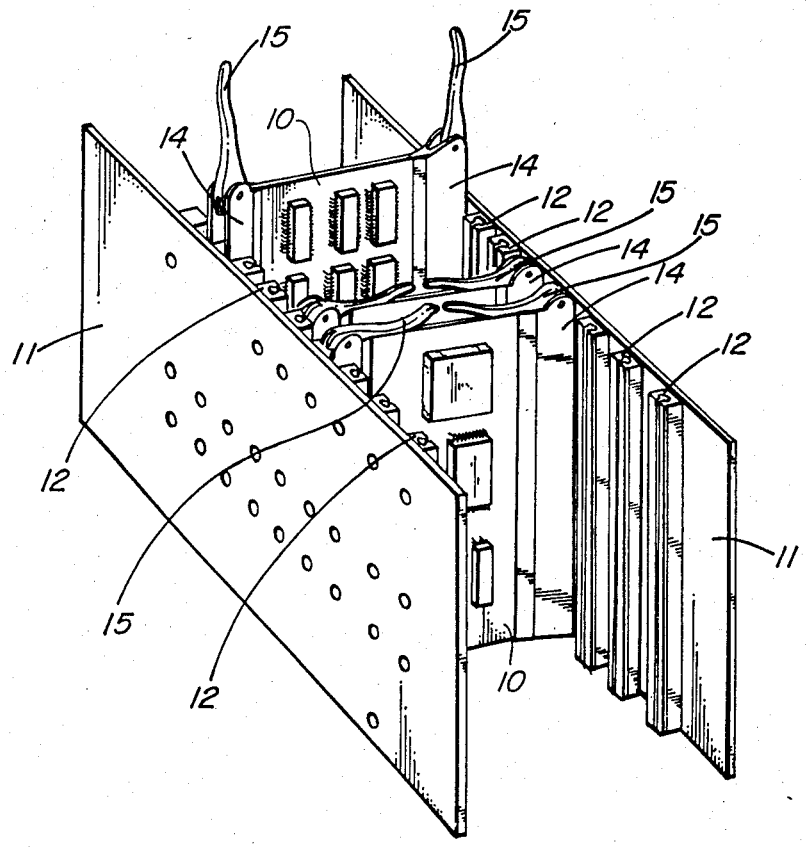
FIG. 3 is a perspective view of a side entry mounting embodying the present invention.

FIG. 3 is a perspective view of an arrangement in which circuit boards are inserted in the "side entry" manner, using the present invention. The circuit boards, indicated at 10 extend between two support structures 11. Connector parts 12, having contact members—not seen in FIG. 3, are attached to the support structures 11. Connector parts 14 having cantilever spring contacts—again not seen in FIG. 3—are attached to opposite edges of the circuit boards 10. Means are provided in the connector parts 14 for disengaging, or deflecting, the cantilever spring contacts prior to insertion of the circuit boards by sliding connector parts 14 over connector parts 12. These means are actuated by the levers 15, the levers in the up position causing deflection of the contacts, while folding down of the levers releases the contacts.

For a one side mounting, as in FIG. 2, only one connector part 12 is provided and only one connector part 14.

Figure 4:
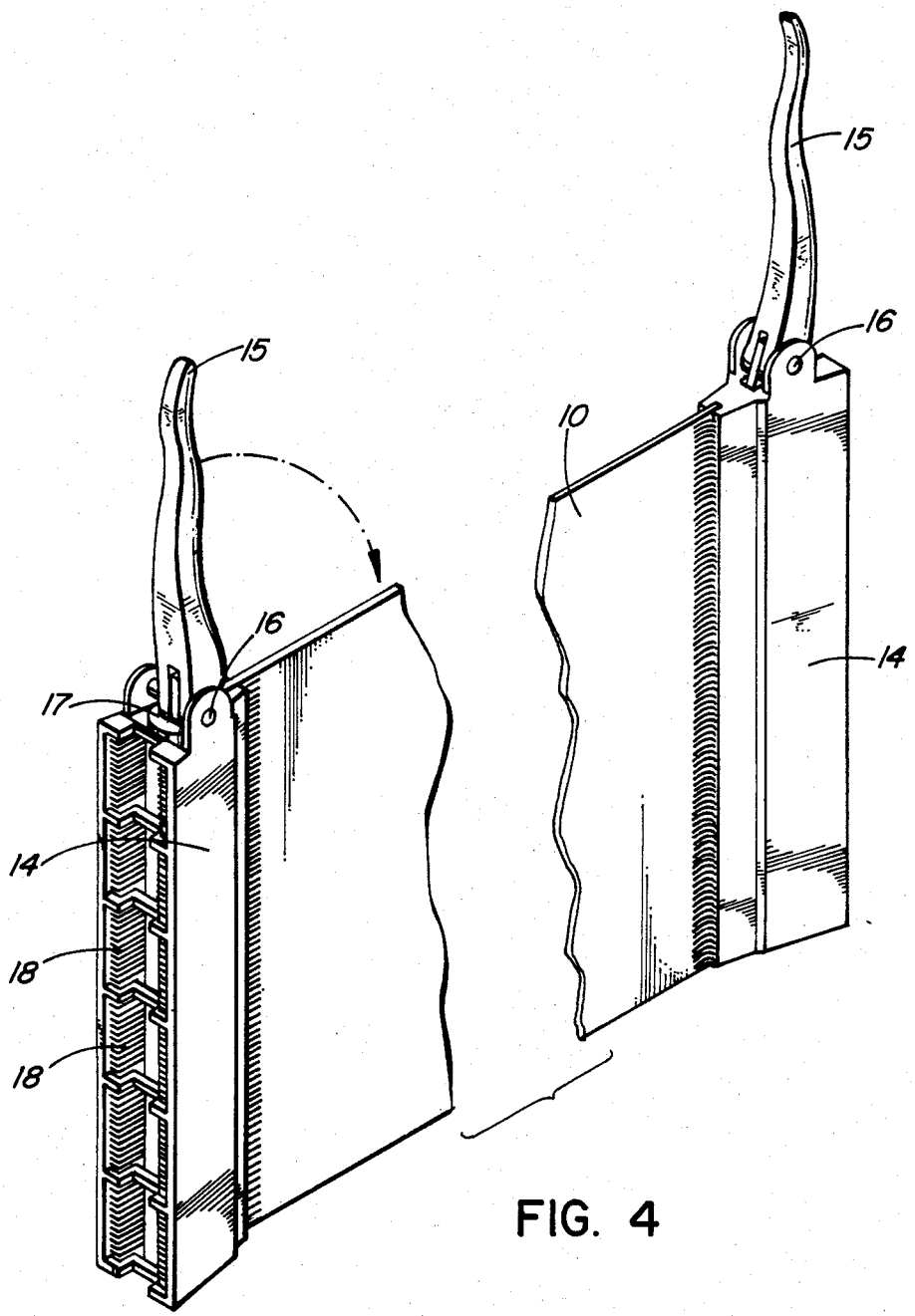
FIG. 4 is a perspective view of a circuit board with attached connector parts, as used in FIG. 3.

The arrangement of circuit board and connector parts 14, as in FIG. 3, is seen more clearly in FIG. 4. The levers 15 are pivotally mounted at 16 on the housing of the connector part 14. The levers move actuators in a longitudinal direction, an actuator indicated at 17. Cantilever spring contact members are displaced outward into slots in the sides of the housing, indicated generally at 18.

Figure 5:
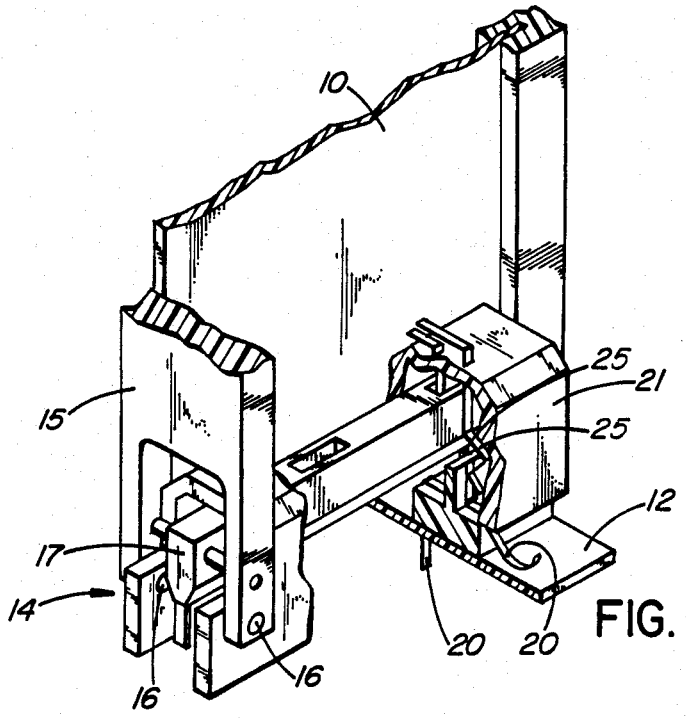
FIG. 5 is a very diagrammatic illustration of a connector part attached to a circuit board, as can be used in FIG. 4.

FIG. 5 illustrates diagrammatically one connector. Connector part 12 is attached to a support structure, for example a back plane 11. On the connector part 12 are mounted contact members 20. In the example, there are two rows of contact members 20. Extending over the connector part is connector part 14 comprising an elongate housing 21 within which is supported the elongate actuator or actuating member 17. The actuating member 17 is capable of reciprocal movement along the housing 21 and also capable of reciprocal movement towards and away from the connector part 12. A lever 15 is attached to one end of the actuator which is caused to move toward connector part 12 as it is moved sideways—longitudinally—by the lever 15. This is obtained by inclined ramps or cams on the housing 21. Cantilever spring contacts 25 are positioned in the housing 21, in the example in two lines, are on each side of the actuating member 17. The free ends of contacts 25 make contact with the contact members 20.

FIG. 6 illustrates the various individual items in somewhat idealized form to illustrate the method of working. The example illustrated is relatively short, for a connector with for example, 100 contacts in two lines of 50. The connector illustrated in FIG. 4 for example, might be for about 200 contacts in two rows of 100. These figures are purely illustrative. In FIG. 6 is seen, in phantom, the elongate housing 21 of the connector part 14, and the elongate actuating member 17. The elongate housing comprising connector part 12 is also seen.

Housing 21 is in the form of a hollow box, open at the bottom. From the top surface of the housing extends a number of actuating member guide and cam members 26. The cam members 26 have inclined cam surfaces 27. At each end of the housing depends a deflectable locking member 28, each having a laterally extending cam member 29. The actuating member 17 has apertures 30 therethrough and the actuating member is positioned in the housing 21 with the guide and cam members 26 and locking members 28 extending down through the apertures 30.

In the example illustrated, the connector part 12 is in the form of a housing having a central longitudinally extending slot 35 formed in an upstanding rib 34. The lower ends 36 of the guide and cam members 26 ride in this slot, the lower ends of members 26 being reduced in thickness. The housing 21 and actuating member 17, forming connector part 14 are assembled to part 12, in the example illustrated, by sliding the housing 21 lengthwise over the part 12, the lower ends 36 sliding in the slot 35.

Initially, with the lever 15 in the folded down or released position, as in FIG. 5, the actuating member 17 is positioned up against the inner top surface of housing 21, resting above the cam members 29. On movement of the lever 15 to its operative position, as in FIG. 4, the actuating member is moved longitudinally and is caused to move down by the cam surfaces 27. As this downward movement occurs, the actuating member pushes down on the cam members 29 deflecting the lock members 28.

It will be seen in FIG. 6 that at each end of the housing forming the connector part 12, a projection 38 extends into the slot 35. These projections have two functions. Firstly, the locking members 28, in their undeflected positions, are positioned in the slot 35 toward the front of the slot as considered in FIG. 6. Thus the locking members cannot pass out of the slot 35, or, if the housing 21 is separated from connector part 12, cannot enter the slot 35. On movement of the actuating member to push down the actuating member on guide and cam members 26, the locking members are deflected and can then pass through the reduced width portions 39 of the slot. This enables the housing 21, that is the connector part 14, to be asseabled to, or disassembled from, part 12.

The second function of the projection 38 is to ensure the correct orientation of a circuit board on insertion—referred to as polarity. At each end of the housing 21, the lower edges of the end walls are shaped to pass over the housing forming connector part 12. There is a central leg 40 which can pass into the slot 35. These legs have a projection 41 on one side. It will be seen that, as illustrated in FIG. 6, the projections 41 can pass below projections 38 and the legs 40 can pass through the reduced width portions 39 of slot 35. However if a circuit board and its attached connector part 14 is reversed, that is the projections 41 extend in the other direction, assembly of connector part 14 to connector part 12 cannot occur.

The first function of preventing assembly of the connector parts unless the actuating member is in its downward position, will be appreciated from FIG. 7. FIG. 7 illustrates the connector in a connecting condition, that is the cantilever spring contacts 25 are in electrical contact with contacts 20. The actuating member 17 is in its upward position, resting on and being held centrally and upward by the cam members 29 (FIG. 6). As seen in FIG. 7, the bottom corners of the actuating member 17 are chamfered, at 42. In the non-actuating position, as in FIG. 7, the actuating member is just touching, or preferably, slightly clear of the cantilever spring contacts 25. The cantilever spring contacts have an inwardly inclined section 43. Thus the spring contacts 25 press on the contacts 20. It will be appreciated that any attempt, deliberately or accidentally, to slide one connector part lengthwise relative to the other will cause considerable damage to the contacts. Hence the function of the projections 38 to prevent such movement unless the actuating member is pushed down. The actuating member pushes on the inclined section 43. This pushes the cantilever spring contacts outward into the slots 18 in the side walls of the housing 21, as indicated in dotted outline at 25*a*.

Figure 7A:
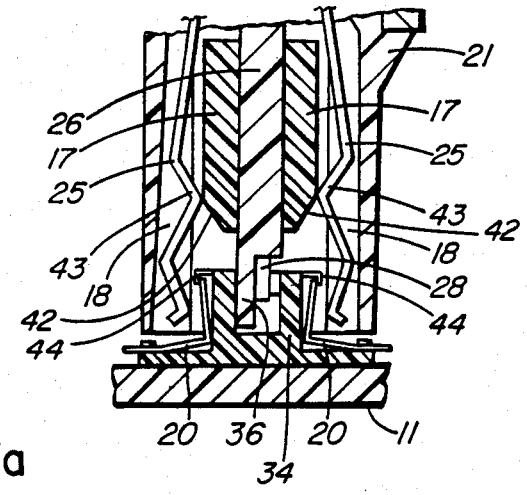

The action of the actuating member 17 is illustrated also in FIG. 7*a*. In this figure, the actuating member is in the downward position and the chamfered corners 42 have pushed the cantilever spring contacts 25 outward. A secondary effect which can be provided also is illustrated in FIG. 7*a*. The contacts 20 can be arranged so that in a free position they extend away from the connector part 12, as shown. The upper ends of the contacts 20 rest in small apertures in a rib 44 extending along the outer top edge of the connector part 12. The apertures restrict outward movement of the upper ends of the contacts 20. With this arrangement, as the actuating member 17 moves upward and releases the cantilever spring contacts 25, the spring contacts 25 press against the contacts 20 pushing them against the connector part 12. The contacts 20 pivot about a position close to their attachment to the bottom of the connector part 12 and a wiping action occurs between the cantilever spring contacts 25 and contacts 20.

FIG. 8 is a longitudinal cross-section of a connector as in FIG. 7. This connector is a longer one than that illustrated in FIG. 6, and may have up to about 200 contacts on each connector part. There would normally be three guide and cam members 26. The pivotal attachment of the lever 15 to the actuating member 17 is indicated at 45. A slot is required in either the lever or the actuating member to allow for the differential movement of lever and actuating member.

While, in FIG. 7, and in FIGS. 5 and 6, the actuating member has been shown and described as moving towards connector part 12 as the lever moves from an inoperative position, with the pressing of the cantilever spring contacts 25 outwards, a different arrangement can be provided. Thus it can be arranged that the upward movement of the actuating member, away from connector part 12, will move the contacts 25 apart.

A front entry connector can have the polarity and locking arrangement as in FIG. 6, but this would require a small sliding movement, longitudinal of the connector to obtain a correct final assembly. Alternatively a connector without polarization and locking features can be used and this will be very similar to the arrangement illustrated in FIG. 5.

What is claimed is:

1. A multiple contact connector comprising:

an elongate housing;

a plurality of cantilever spring contacts mounted in said housing, in at least one linear array;

an elongate actuating member mounted for reciprocal longitudinal movement in said elongate housing;

interengaging formations on said elongate housing and said elongate actuating member;

a deflectable locking member extending down from a top surface of said elongate housing adjacent to each end of the housing;

a laterally extending cam member on one side of each locking member;

an aperture adjacent each end of said actuating member, extending through said actuating member, said locking members extending through said apertures;

the arrangement such that on reciprocal longitudinal movement of said actuating member said interengaging formations move said actuating member also reciprocally in a diretion normal to said longitudinal movement, to move said spring contacts out of a contact position and return said spring contacts to a contact position, said actuating member also engaging with said cam member on each locking member to deflect said locking members laterally on movement of said spring contacts out of a contact position.

2. A connector as claimed in claim 1, said plurality of spring contacts extending in two parallel linear arrays.

3. A connector as claimed in claim 1, each cantilever spring contact having a section inclined in a direction normal to longitudinal axis of the actuating member, said actuating member pressing on and sliding down said sections to move said cantilever spring contacts out of a contact position.

4. A connector as claimed in claim 2, said cantilever spring contacts each having an inclined section, the sections in each linear array being inclined inwardly toward an axis extending between the linear arrays.

5. A connector as claimed in claim 4, each cantilever spring contact having a contact portion at a lower end, said inwardly inclined sections being positioned above said contact portions.

6. A connector as claimed in claim 5, said actuating member being positioned between said linear arrays.

7. A connector as claimed in claim 5, said inclined sections being inclined downward and inward, and said actuating member being positioned between said linear arrays and above said inclined sections.

8. A connector as claimed in claim 1, said elongate housing of box-like form having top, sides and ends, and an open bottom, and including a plurality of guide members extending down from the top of the housing; a plurality of apertures in said actuating member, an aperture for each guide member, the guide members extending into said apertures; said interengaging formations comprising an inclined surface on each of said guide members and cooperative surfaces on said actuating member.

9. A connector as claimed in claim 1, comprising a further elongate housing having an upstanding rib and a central slot extending longitudinally in said rib, the slot extending to the ends of said further housing; a plurality of contact members positioned on said further elongate housing, in two linear arrays, an array at each side of said upstanding rib; a projection at each end of said slot, the projections extending laterally part way across said slot to define reduced width portions of said slot; said locking members in an undeflected position being aligned with said projections and in a deflected position being aligned with said reduced width portions of said slot for passage of said locking members through said reduced width portions.

10. A connector as claimed in claim 1, further comprising an elongate connector part having a plurality of contact members mounted thereon, in at least one linear array, a contact member for each cantilever spring contact in said elongate housing.

11. A connector as claimed in claim 10, said plurality of contact members extending in two parallel linear arrays and said cantilever spring contacts extending in two parallel linear arrays.

12. A connector as claimed in claim 9, said projections extending from the same side of said slot.

13. A connector as claimed in claim 8, further comprising a further elongate housing having an upstanding rib and a cental slot extending longitudinally in said rib, the slot extending to the ends of the further housing; a plurality of contact members positioned on said further elongate housing in at least one linear array, a contact member for each cantilever spring contact; a projection at each end of said slot, the projections extending laterally part way across said slot to define reduced width portions of said slot; said ends of said box-like elongate housing each having an aperture for passage of said further elongate housing therethrough, each aperture having a central leg extending downwardly and aligned with said slot each leg having a lateral projection at its lower end and a portion of reduced width above said projection, the arrangement such that the legs can slide in said slot, the lateral projections on said legs positioned below the projections at the ends of the slots and the portions of said legs of reduced width passing through the reduced width portions of said slot.

14. A connector as claimed in claim 1, including a lever pivotally mounted at one end on said elongate housing and pivotally connected to said elongate actuating member, pivotal movement of the lever moving said actuating member longitudinally.

15. A connector as claimed in claim 1, including a further elongate housing; a plurality of contact members positioned on said further housing in at least one linear array, a contact member for each contilever spring contact; reciprocal movement of said actuating member moving said spring contacts into contact with and out of contact with said contact members.

16. A connector as claimed in claim 15, each contact member including a base portion attached to said further housing and cantilever portion extending from said base portion and capable of moving relative to said further housing, whereby on contact occurring between a spring contact and a contact member, said cantilever portion is deflected to move relative to said spring contact and provide a contact wiping action.

* * * * *